US010836593B2

(12) United States Patent
Dahlqvist et al.

(10) Patent No.: US 10,836,593 B2
(45) Date of Patent: Nov. 17, 2020

(54) DEVICE FOR FEEDING PAPERS

(71) Applicant: PLOCKMATIC INTERNATIONAL AB, Hägersten (SE)

(72) Inventors: Patrik Dahlqvist, Täby (SE); Tommy Lindström, Hägersten (SE)

(73) Assignee: PLOCKMATIC INTERNATIONAL AB, Hägersten (SE)

( * ) Notice: Subject to any disclaimer, the term of this patent is extended or adjusted under 35 U.S.C. 154(b) by 0 days.

(21) Appl. No.: 16/090,463

(22) PCT Filed: Mar. 31, 2017

(86) PCT No.: PCT/SE2017/050323
§ 371 (c)(1),
(2) Date: Oct. 1, 2018

(87) PCT Pub. No.: WO2017/171627
PCT Pub. Date: Oct. 5, 2017

(65) Prior Publication Data

US 2019/0112136 A1 Apr. 18, 2019

(30) Foreign Application Priority Data

Apr. 1, 2016 (SE) ..... 1650440

(51) Int. Cl.
*B65H 3/12* (2006.01)
*B65H 1/14* (2006.01)
*B65H 3/48* (2006.01)

(52) U.S. Cl.
CPC ..... *B65H 1/14* (2013.01); *B65H 3/128* (2013.01); *B65H 3/48* (2013.01);
(Continued)

(58) Field of Classification Search
CPC ... B65H 3/08; B65H 3/14; B65H 3/12; B65H 3/0816; B65H 3/48; B65H 3/128; B65H 2553/30; B65H 2553/40; B65H 7/02
See application file for complete search history.

(56) References Cited

U.S. PATENT DOCUMENTS 6,186,492 B1 * 2/2001 Dechau ..... B65H 1/18 271/11
6,784,415 B2 * 8/2004 Kudo ..... G01V 8/20 250/221

(Continued)

OTHER PUBLICATIONS

International Search Report dated Jun. 30, 2017 for PCT Application No. PCT/SE2017/050323.

(Continued)

*Primary Examiner* — Thomas A Morrison
(74) *Attorney, Agent, or Firm* — Moser Taboada

(57) ABSTRACT

Disclosed is a paper feeding device (10) comprising a storage surface (14) for a stack of papers (12), with a leading edge (14*a*), a trailing edge (14*b*), and a first and a second side edge (14*c*, 14*d*). The surface (14) is adapted to be moved vertically. The device further comprises a vacuum feeder (16) for feeding papers from their position on the storage surface (14) and imparting on an uppermost sheet of paper (12*a*) a horizontal displacement, and a blower arrangement (18, 20) adapted to provide a curtain of air separating the uppermost sheet of paper (12*a*) from the rest of the stack of papers. The device further comprises a sensor arrangement (22) arranged to determine where the upper paper sheets in the stack of papers (12) start to separate from the rest of the paper sheets, the sensor arrangement (22) comprising a plurality of infrared reflective sensors (22*a*).

7 Claims, 5 Drawing Sheets

(52) U.S. Cl.
CPC .... *B65H 2511/152* (2013.01); *B65H 2511/22* (2013.01); *B65H 2553/41* (2013.01); *B65H 2553/414* (2013.01); *B65H 2553/416* (2013.01)

(56) References Cited

U.S. PATENT DOCUMENTS 7,267,337 B2 * 9/2007 Moore ..... B65H 1/18 271/148
8,867,045 B2 * 10/2014 Piana ..... G01V 8/20 356/614
9,569,953 B2 * 2/2017 Micko ..... G01B 11/00
2003/0113124 A1 * 6/2003 Barlow ..... B65H 1/12 399/23
2008/0264092 A1 * 10/2008 Chase ..... B67D 1/0858 62/389
2010/0032892 A1 2/2010 Clark et al.
2012/0154795 A1 * 6/2012 Kobayashi ..... B65H 1/14 356/213
2013/0070232 A1 * 3/2013 Izukawa ..... G06F 3/0304 356/51
2014/0061999 A1 3/2014 Okamoto
2014/0367401 A1 * 12/2014 Stralin ..... A47K 10/22 221/6
2015/0233702 A1 * 8/2015 Micko ..... G01B 11/00 250/340
2015/0233765 A1 * 8/2015 Micko ..... G01B 11/00 250/342
2016/0090249 A1 3/2016 Suzuki et al.

OTHER PUBLICATIONS

International Preliminary Examining Authority dated Jul. 4, 2018 for PCT Application No. PCT/SE2017/050323.

* cited by examiner

DEVICE FOR FEEDING PAPERS

TECHNICAL FIELD

The present invention relates generally to a paper feeding device for feeding sheets of paper in a feeder or sorter.

BACKGROUND ART

There are essentially two types of feeders for use for after-treatment of sheets of paper in printing machines and copiers, viz. friction feeder and vacuum feeders. In friction feeders, individual sheets are picked from piles of sheets by a rotary feeding roll abutting against and pulling the top sheet from the pile, wherein a subjacent friction block normally retains subjacent sheets of the pile. Friction feeders are robust and in general reliable in operation, but occasionally more than one sheet at a time may happen to be picked mistakenly. The feeding rolls may also leave marks in the sheets. In vacuum feeders, sheets are picked from piles by the fact that the top sheet of the pile is sucked against a conveyor belt for transportation of the sheet to subsequent further processing. The vacuum feeder does not have the disadvantages mentioned above of the friction feeder, but the function thereof is more sensitive and a vacuum feeder is considerably more expensive than a friction feeder.

A vacuum feeder picks individual sheets of paper from a paper stack. First, the uppermost sheets of papers are separated by means of separation air and levitation air which are blown into the upper portion of the stack of papers. As the uppermost sheet of paper is separated it is lifted towards a vacuum unit comprising vacuum belts, which are rotating around a suction unit. Thereby, the uppermost sheet of paper is pulled from the stack of papers.

A drawback of prior art vacuum feeding machines is the mechanical solutions used for determining where over time a homogenous stack of papers is present. Between the homogenous stack of papers and the vacuum belts there is an area, the separation area, where air and paper are mixed. The position of the homogenous stack of papers controls the operation of the elevator which lifts the stack of papers at the same rate as the vacuum feeding machine feeds the paper sheets, i.e, at the rate which the uppermost paper sheet is removed from the stack of papers. These mechanical designs puncture the air bed which is built up over time in the separation area, which increases the risk of double feedings.

SUMMARY OF INVENTION

An object of the present invention is to provide a paper feeding device wherein the position of a homogenous stack of papers can be determined without puncturing the air bed in the separation area.

According to a first aspect of the invention there is thus provided a paper feeding device comprising a storage surface for a stack of papers, the storage surface having a leading edge, a trailing edge, and a first and a second side edge and being adapted to be move vertically between a first, lower end position and a second, upper end position. The device further comprises a vacuum feeder for feeding papers from their position on the storage surface and imparting a horizontal displacement on an uppermost sheet of paper. The device further comprises a blower arrangement adapted to provide a curtain of air separating the uppermost sheet of paper from the rest of the stack of papers. The device further comprises a sensor arrangement arranged to determine where the upper paper sheets in the stack of papers provided on the elevator start to separate from the rest of the paper sheets, the sensor arrangement comprising a plurality of infrared reflective sensors arranged in at least one vertical row.

In one embodiment, the infrared sensors are arranged in two parallel rows. In some embodiments, the two parallel rows with sensors are vertically displaced relative to one another, in order to achieve a higher resolution from the sensors.

A paper processing machine comprising a paper feeding device according to the invention is also provided.

BRIEF DESCRIPTION OF DRAWINGS

The invention is now described, by way of example, with reference to the accompanying drawings, in which.

DESCRIPTION OF EMBODIMENTS

In the following, a detailed description of a paper feeding device according to the invention will be given. Special references given in the description, such as "up" or "down", refer to directions during normal operation of the device.

Figure 1:
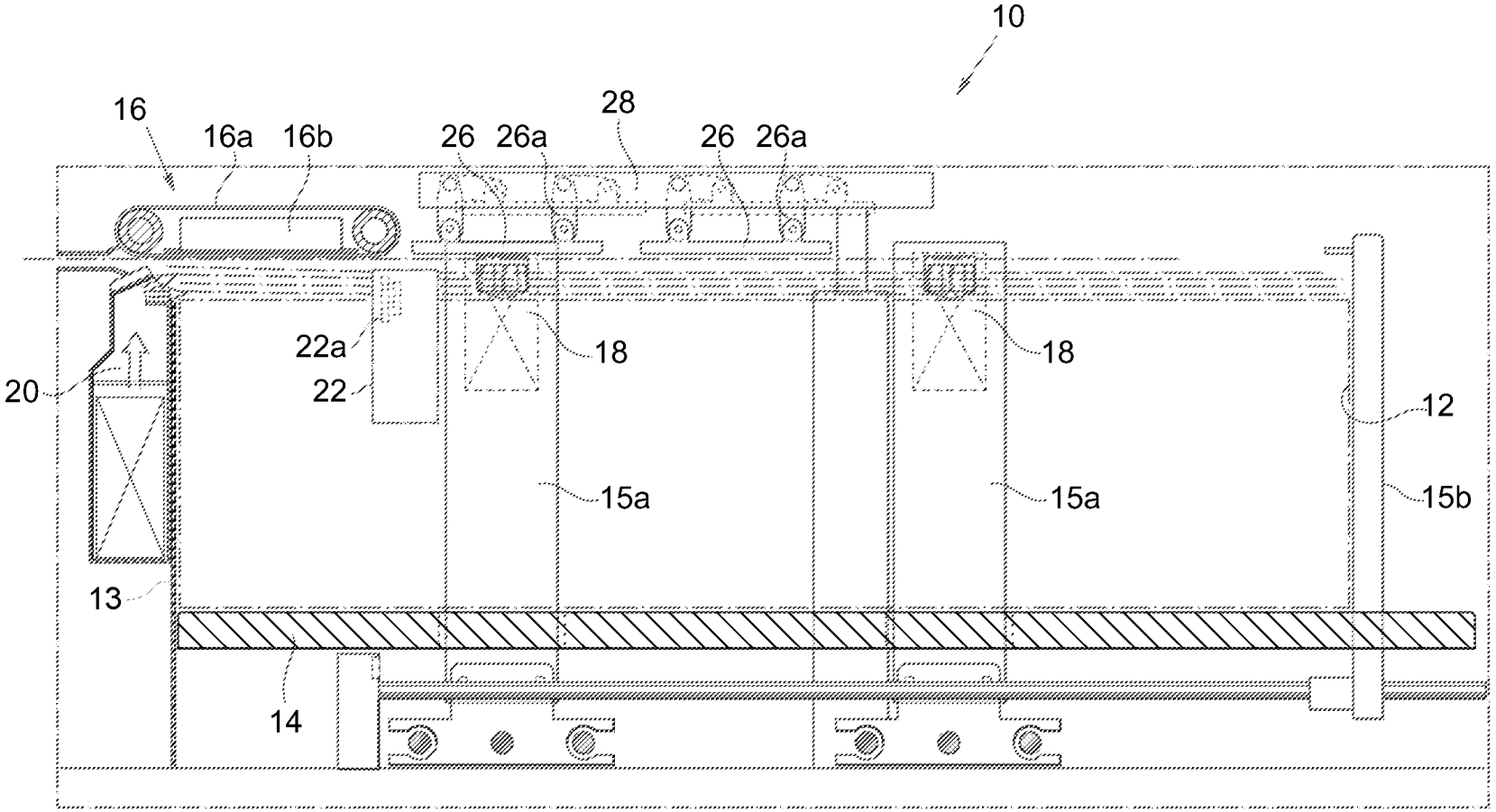
FIGS. 1 and 2 show an embodiment of a paper feeding device according to the invention from a side and a top view, respectively, which is provided with a vacuum feeder.
Figure 2:
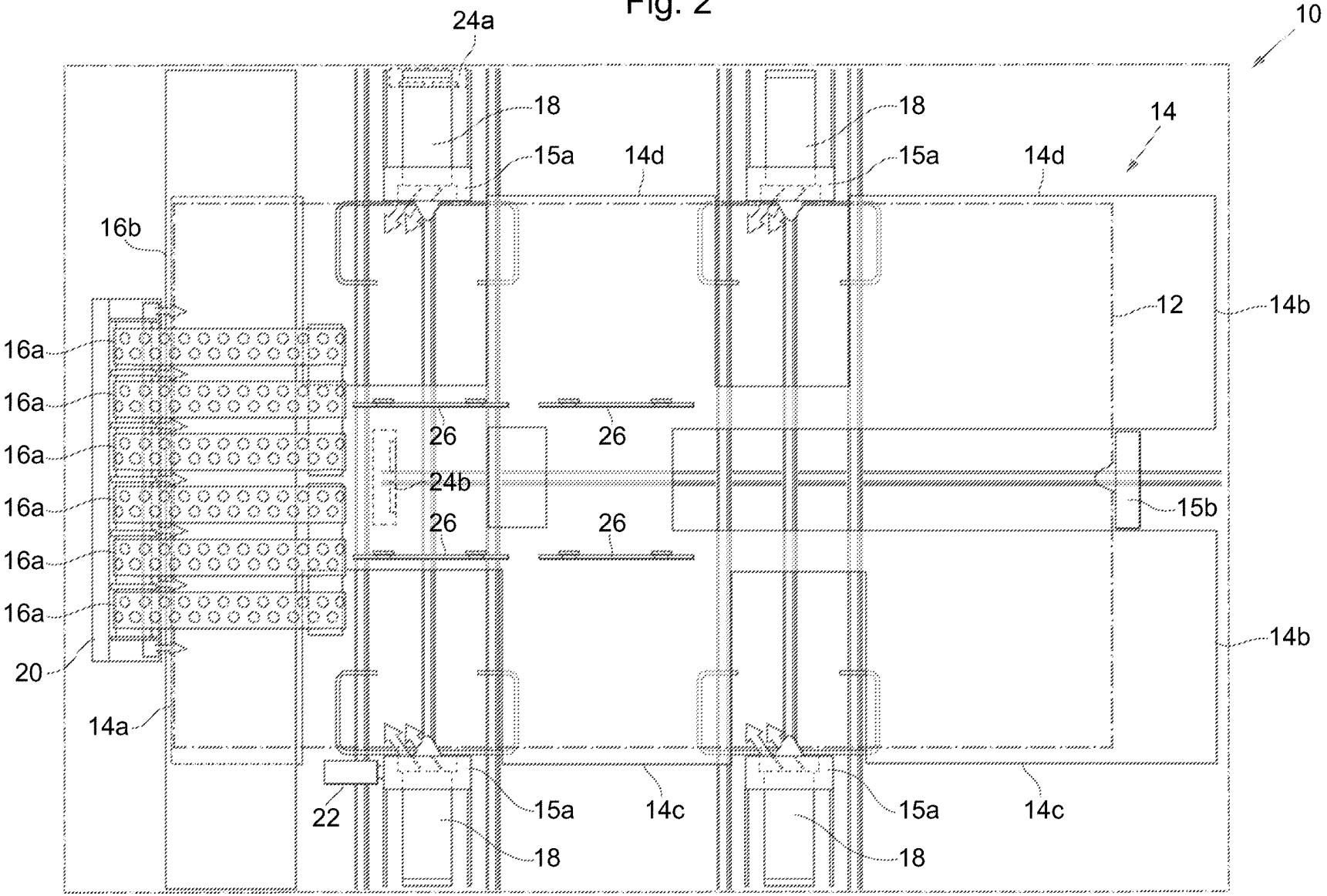

Reference is first made to FIGS. 1 and 2 showing a paper feeding device 10 according to the invention provided with a vacuum feeder. A stack of papers 12 is provided on a storage surface 14 in the form of a mechanical elevator adapted to be move vertically between a first, lower end position and a second, upper end position by means of a mechanical arrangement (not shown in the figures). In this context, the term "stack of papers" should be interpreted as at least two sheets of paper, but usually the stack of papers comprises a much higher number of sheets. The storage surface 14 has a leading edge 14*a*, a trailing edge 14*b*, and a first and a second side edge 14*c*, 14*d*.

The paper feeding device 10 further comprises adjustable paper guides for positioning of the stack of papers 12. Thus, four side guides 15*a* are provided, two on each side edge 14*c*, 14*d* of the storage surface 14 and an end guide 15*b* is provided at the trailing edge 14*b* of the storage surface 14. Thus, the side guides 15*a* are provided along the first and second side edges 14*c*, 14*d* and somewhere between the leading edge 14*a* and the trailing edge 14*b* of the storage surface 14. The side guides 15*a* cooperate so that the side guides on the different sides move an equal distance to keep the stack of papers 12 centrally positioned on the elevator 14 with respect to the longitudinal axis of the paper feeding device. The movable end guide 15*b* is adapted to control the length of the storage surface 14, by changing the distance between the leading edge 14*a* and the end guide 15*b*. Typically, the guide is positioned such that the papers are as close as possible to the leading edge 14*a*, which means that the stack of papers 12 abuts a stopping plate 13 at the leading edge 14*a* of the storage surface 14. The operating position of the stack of papers 12 is shown in FIG. 2 by dash-dotted lines.

A vacuum feeder 16 extends across essentially the entire with of the stack of papers 12 and comprises in the shown embodiment five feeding belts 16*a* provided around a suction box 16*b* adapted to, during operation, generate an under-pressure to make a sheet of paper from the stack of papers adhere thereto for subsequent transportation by means of the feeding belts. Thus, the vacuum feeder 16 is provided for the feeding of papers from their position on the storage surface 14 and imparts the uppermost sheet of paper 12*a* a horizontal displacement to the left, as shown in the figures. It is also shown that the stack of papers 12 is centred with respect to the vacuum feeder 16.

The paper feeding device 10 also comprises a blower arrangement in the form of pairs of side blower units 18 adapted to provide a flow of air separating the uppermost sheet of paper 12*a* from the rest of the stack. The blower units are provided on the upper portion of the side guides 15*a*. This means that they are provided along the first and second side edges 14*c*, 14*d* of the storage surface 14 and somewhere between the leading edge 14*a* and the trailing edge 14*b* thereof.

Each side blower unit 18 is preferably provided with a fan and a nozzle having a slot-shaped exhaust opening substantially horizontal or orientated substantially parallel to the storage surface. The nozzle will now be described with reference to FIGS. 3*a* and 3*b*.

Figure 3A:
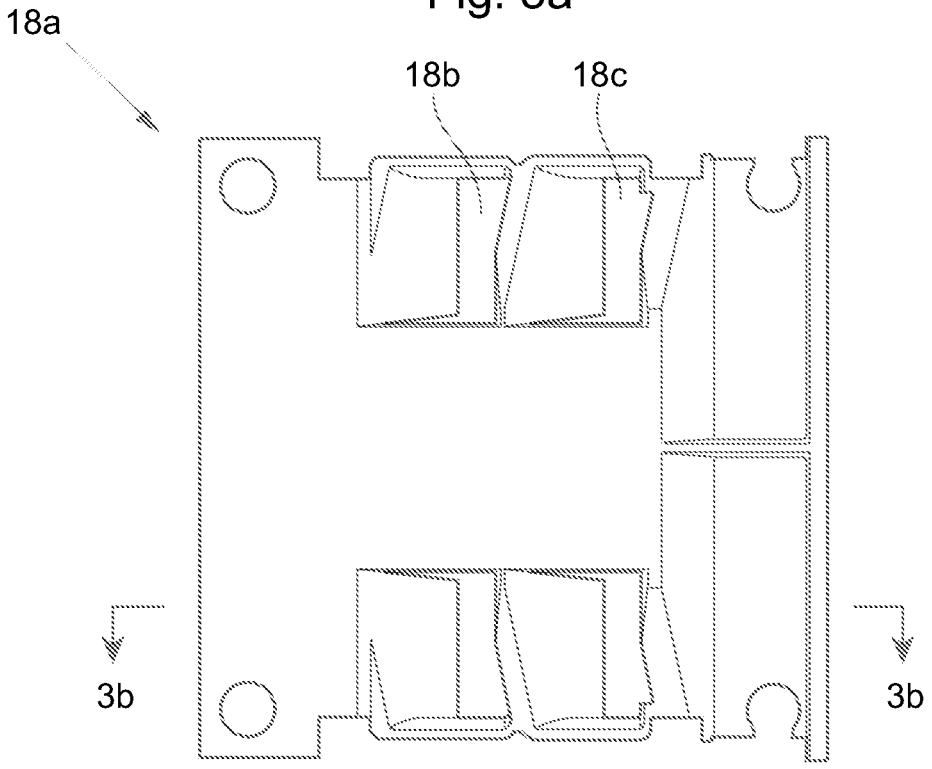
FIGS. 3*a* and 3*b* show a side blower unit nozzle in a side and top sectional view, respectively.
Figure 3B:
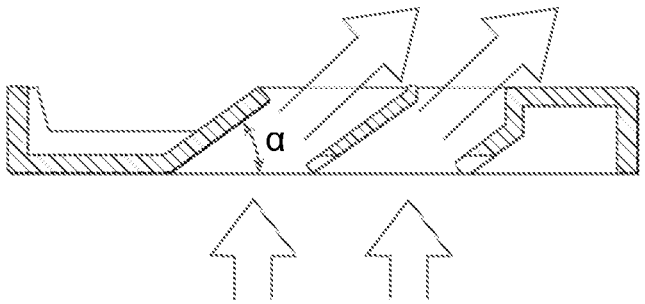

In the embodiment shown in FIGS. 3*a* and 3*b*, the nozzle 18*a* has two air openings 18*b*, 18*c*, preferably with a height of 20 mm and a width of 10 mm. The narrow air openings create a turbulent air flow. In the preferred embodiment, the air openings are directed at an angle $\alpha$ of between 30° and 80°, more preferably between 40° and 70°, even more preferably between 50° and 60°, most preferably at 56° in relation to the side edges 14*d*, 14*c* of the storage area, which also entails that the angle is relative to the flow direction of air from the fan, as shown in FIG. 3*b*. This results in an air flow directed partly in the feeding direction of the paper feeding device 10, see FIG. 2. This air flow cooperates with the air flow from a front blower unit, as will be described below.

It is seen in FIG. 3*a* that the part 18*a* comprises two sets of openings 18*b*, 18*c*. This is to reduce the number of different parts in the paper feeding device. The air flow from the side blower units 18 is directed essentially in the direction of the paper feeding, i.e. to the left in a horizontal direction as seen in FIGS. 1 and 2. The nozzles 18*a* are mirrored on the different sides of the storage surface 14, i.e. the air from the fans are deflected to the left on one side and to the right on the other side. By providing openings only for one set of openings 18*b*, 18*c* in each guide 15*a* and rotating the nozzle 18*a* 180 degrees before mounting, the same kind of part can be used for all four side guides 15*a*.

Figure 4A:
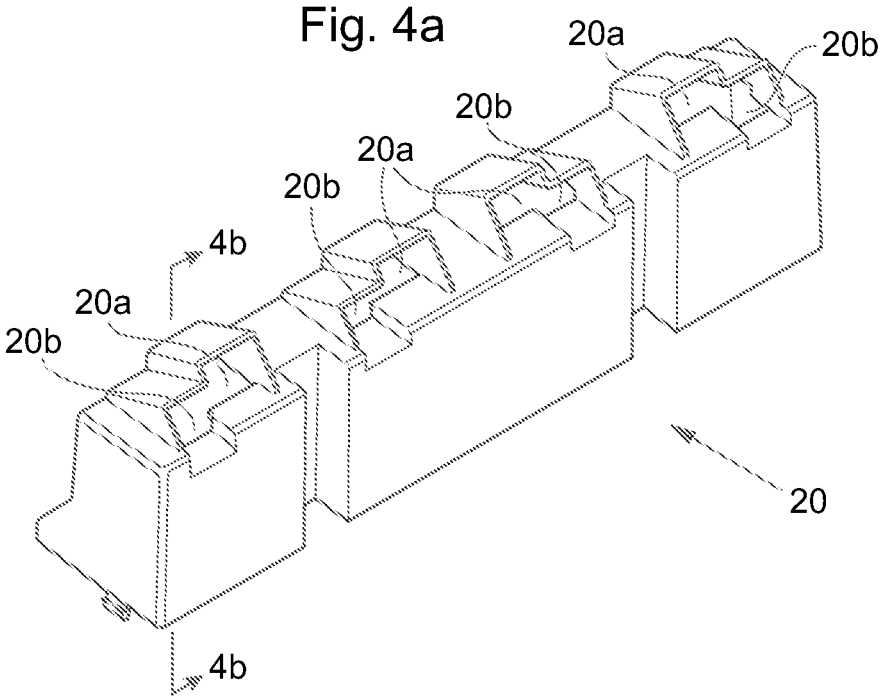
FIGS. 4*a* and 4*b* show a front blower unit comprised in the paper feeding device of FIGS. 1-3 in a top and side sectional view, respectively.

The blower arrangement also comprises a front blower unit 20 mounted in front of the stack of papers 12, i.e., along the leading edge 14*a* of the storage surface 14. When a paper sheet is moved by the vacuum feeder 16 it will pass above the front blower unit 20. The front blower unit 20 provides multiple air flows, preferably four, by means of a respective air opening. Each of the air openings is made up of a first portion 20*a* and a second portion 20*b*, see FIG. 4*a*. The width of each air opening is between 20 and 40 mm, more preferably between 25 and 35 mm, and most preferably about 28 mm. The height of each air opening is between 10 and 20 mm, most preferably about 14 mm. Thus, each opening of the multiple openings has substantially the same shape, which in turn results in that the multiple air flows are all substantially the same, wherein one air flow flows out of a respective opening.

The air openings are designed such that the air from each air opening is separated into two different cones in order to obtain a turbulent air flow. Approximately 60% of the air creates a first air cone 20*a*' with a height of 10 mm when it impinges the stack of papers 12 at a distance of about 10 mm. The remaining air, i.e. approximately 40% of the air, creates a second air cone with a similar, although approximately 50% smaller, geometry, but which is vertically displaced approximately 5 mm in relation to the first air cone. In this way, the front blower unit 20 will cover a larger vertical distance from the vacuum belts 16*a*. The major part of the total air, flow, i.e. the approximately 60% that constitute the first air cone, is directed at a steeper angle than the 40% that constitute the second air cone towards the vacuum belts 16. This is due to the separation at the top part of the stack of papers is more important than separation at a lower portion of the stack of papers, since the final separation of the paper sheets happens close to the vacuum belts 16*a*, i.e. close to the top of the stack of papers.

Referring to FIG. 2, it can be seen that the air flows from the side blower units 18 and the front blower unit 20 cooperate. Typically, the air flows meet somewhere close to the leading edge of the storage surface 14, which in turn is close to a leading edge of the stack of papers. The air flow from the side blower units 18 is directed essentially in the direction of the paper feeding and the air flow from the front blower unit 20 is directed in the direction opposite to the paper feeding. This results in a total air flow which separates the upper paper sheets in the stack of papers 12 and which simultaneously prevents curling of lifted paper sheets.

Figure 4B:
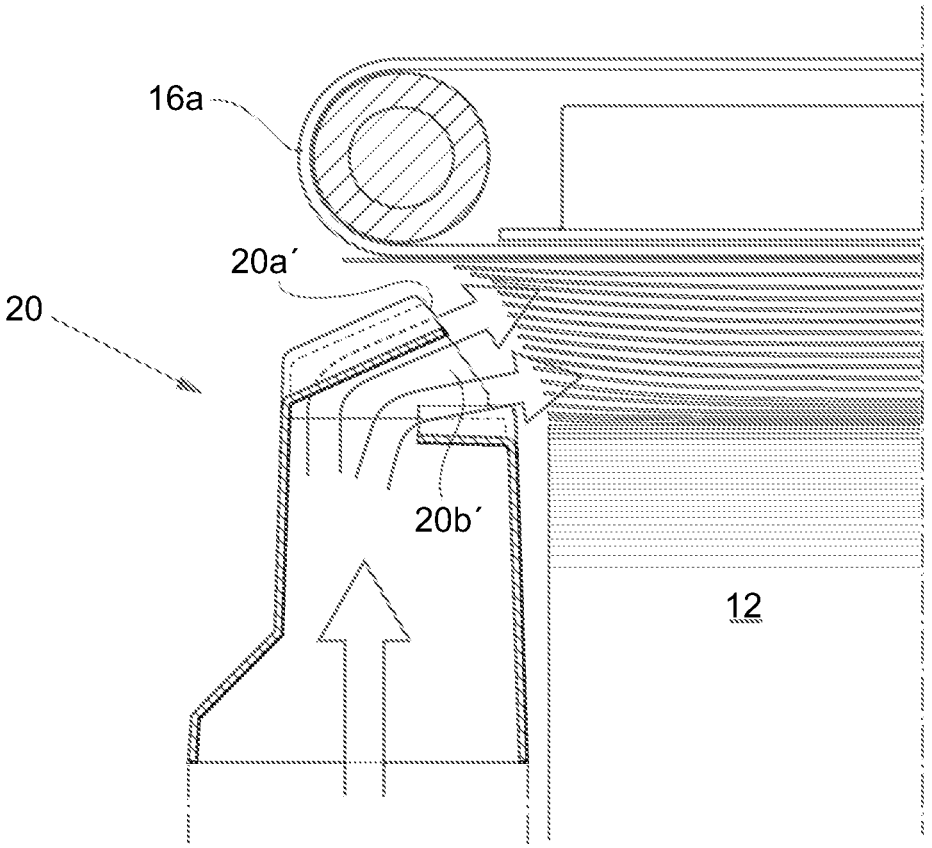
Figure 5A:
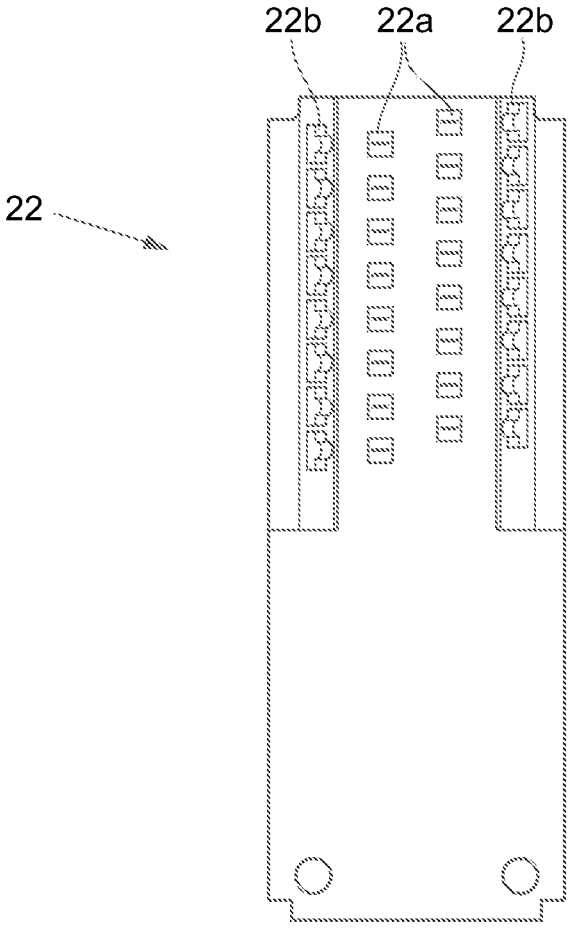
FIG. 5 shows a side view of a sensor arrangement comprised in the paper feeding device of FIGS. 1-3.

The paper feeding device 10 also comprises a sensor arrangement 22, shown in detail in FIG. 5, which is arranged to determine the position of the homogenous stack of papers, i.e., where the upper paper sheets in the stack of papers 12 start to separate from the rest of the paper sheets. The nature of this separation is seen in FIG. 4*b*. The sensor arrangement 22 is adapted to be provided adjacent to a side of the stack of papers 12 and is in the preferred embodiment provided on one of the side guides 15*a*, see FIG. 2. In order to be able to detect the position of the homogenous stack of papers, the sensor arrangement is provided in the area of the upper portion of the stack of papers 12. Referring back to FIG. 5*a*, the sensor arrangement 22 preferably comprises a plurality of infrared (IR) reflective sensors 22*a*, preferably 16 sensors, which are arranged in two parallel rows. The sensors 22*a* in a row have a mutual distance of 2 mm. The sensors 22*a* of the two rows are vertically displaced by half the mutual distance between two sensors in a row, in the present embodiment by 1 mm. This results in an increased resolution for the sensor arrangement 22, due to a staggered arrangement providing twice as many positions in a vertical plane for light to impinge the sensors 22.

Figure 5B:
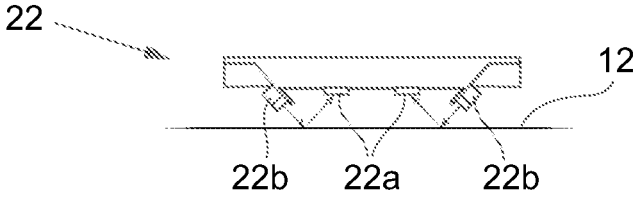

The sensor arrangement 22 preferably also comprises 16 auxiliary IR diodes 22*b*, which provide extra IR light and which can be controlled depending on the requirements, and is used especially when the natural lighting conditions are insufficient. In FIG. 5*b* it is shown how the light from the auxiliary IR diodes 22*b* is emitted at an angle to the stack of papers 12 and is thus reflected so that it impinges the reflective sensors 22*a*. FIG. 5*b* is a top view of the sensor arrangement 22 and the stack of papers 12, and thus the light, as shown in the figure, is emitted in a horizontal plane of the paper feeding device. When the natural lighting conditions are sufficient, the same function is achieved by natural light impinging the reflective sensors 22*a*, rather than the light from auxiliary IR diodes 22*b*.

At start of operation of the paper feeding device 10 a homogenous stack of papers cover eight of the 16 sensors 22*a* of the sensor arrangement 22. A calibration is then performed to make the sensor arrangement independent of the type of paper medium and colour. The position of the homogenous stack of papers, i.e., where the papers start to separate, is determined by the position where the reflection detected by the sensors 22*a* falls below a predetermined threshold value, such as 15%. Thus, the position of the homogenous stack of papers is determined by the vertical position of the uppermost sensor 22*a* detecting a reflection above the threshold value.

The auxiliary IR diodes 22*b* are operated when no reflection above a predetermined threshold value, such as 15%, is detected by the reflective sensors 22*a* at the calibration thereof, which in other words mean that the IR diodes 22*b* are operated only when the original lighting conditions are insufficient to achieve a detection above a certain threshold value. Thus, the operating mode is automatically determined at the start of operation, in the sense that the IR diodes 22*b* are either used, i.e. turned on, or not use, i.e. turned off.

During operation the sensor arrangement 20 performs sampling at regular intervals, in the preferred embodiment every 20 ms, starting at the top and progressing downward. When the sensor arrangement identifies a reflection value which is above the threshold value, this position is submitted to the control unit controlling the operation of the paper feeding device 10. This value is used for controlling the operation of the elevator arrangement controlling the vertical position of the storage surface 14. This is due to the reflection value being indicative of how tightly packed the papers in the stack of papers are, and as such the reflection value will be higher at a bottom part of the stack of papers than at the top of the stack of papers during operation of the paper feeding device, since the paper sheets are more tightly packed at the bottom of the stack of papers.

Again referring to FIGS. 1 and 2, there are shown distance meters 24*a*, 24*b* adapted to measure the distance to an associated paper guide, which in most embodiments also is an opposing paper guide. In order to be able to measure both the length and the width of the stack of papers 12, two different distance meters must be provided. A first distance meter 24*a* is provided below the storage surface 14, in order to avoid blockage by the stack of papers 12. The first distance meter 24*a* is provided behind one of the side guides 15*a* and is thus directed towards the back surface thereof. A second distance meter 24*b* is also provided below the storage surface 14 and in the vicinity of the leading edge 14*a* thereof. Each distance meter 24*a*, 24*b* comprises an ultrasound meter directed towards the respective paper guide.

Before operation of the paper feeding device but after the stack of papers 12 has been placed on the elevator 14, the first and second distance meters 24*a*, 24*b* perform at least one measurement of the distance from the respective distance meter and the respective paper guide, in order to determine the size of the paper sheets in the stack of papers 12. It is preferred that multiple measurements are performed by each distance meter, such as 10 measurements, and that subsequently an averaging is performed. The values Sx and Sy, respectively, are stored and the paper size can be calculated as follows.

The width of the papers in the stack of papers 12 is determined by the first distance meter 24*a*. When the side guides 15*a* are in their rearmost position, i.e., accommodating a maximum width, they are in a basic position. In the present embodiment this accommodates a maximum width $W_{max}$ of 360.0 mm. This basic position is connected to a basic distance $DW_{base}$ from the first distance meter 24*a* and the surface of the side guide 15*a* facing towards the first distance meter 24*a*, for example 20.0 mm. When performing a measurement by the first distance meter 24*a* a distance value $DW_{measured}$ is obtained. It should be noted that the distance value $DW_{measured}$ is always at least as large as the distance value $DW_{base}$.

It has already been mentioned that the associated side guides 15*a* move an equal distance in order to centre the stack of papers 12. Thus, if one side guide 15*a* moves a distance Δ towards the stack of papers 12, the accommodated width is decreased by 2×Δ. These relationships can be used to calculate the accommodated width $W_{accomodated}$ of the stack of papers 12 as follows.

$$W_{accomodated}=W_{max}-2\times(DW_{measured}-DW_{base})$$

For example, given the values in the above example, if the measured distance $DW_{measured}$ is 95.0 mm, the width of the papers in the stack of papers 12 is calculated to 360.0−2×(95.0−20.0)=210.0 mm.

The length of the papers in the stack of papers 12 is determined by the second distance meter 24*b*. This is provided at a fixed distance $DL_{base}$ from the leading edge 14*a* of the storage surface, which is the same as the position of a stopping plate 13 or wall to which the stack of papers 12 abuts in during operation of the device for feeding papers. When the end guide 15*b* is in a position accommodating a maximum length, it is in a basic position. In the present embodiment this position accommodates a maximum length $L_{max}$ of 660.0 mm. When performing a measurement by the second distance meter 24*b* from the distance meter 24*b* to the side of the end guide 15*b* facing towards the distance meter 24*b*, a distance value $DL_{measured}$ is obtained. It has already been mentioned that the second distance meter 15*b* is positioned a distance $DL_{base}$ from the position of a stopping plate 13 or wall to which the stack of papers 12 abuts in during operation, i.e., the leading edge of the stack of papers 12. This can be used to calculate the accommodated length $L_{accomodated}$ of the stack of papers 12 as follows.

$$L_{accomodated}=(DL_{measured}+DL_{base})$$

For example, given the values in the above example, if the measured distance $DL_{measured}$ is 197 mm, the length of the papers in the stack of papers 12 is calculated to 197.0+100=297.0 mm.

Referring to FIG. 1, upper paper stops 26 are shown from the side. In the lower position thereof which is shown in solid lines the underside of the upper paper stops 26 is aligned with the underside of the vacuum unit 16, i.e. with the vacuum belts 16*a*. In this way, when air from the side and from blowing units 18, 20 forces the uppermost paper sheet upward, towards the vacuum belts 16*a*, the upper paper stops 26 prevent this paper sheet from bending. In other words, the vacuum unit 16 and the upper paper stops 26 together keep the uppermost paper sheet in a horizontal paper path. The upper paper stops 26 are suspended by means of pivotable arms 26*a* extending from the roof 28 of the compartment housing the stack of papers 16.

The upper paper stops 26 are divided into two parts, and it preferably has a gap in between the parts, see FIG. 2, to provide an even abutment for the paper sheets when they are lifted by the separation air, keeping them in the horizontal. This in turn avoids puncturing of the air bed build up by means of the blower units which results in better performance of the paper feeding device. By having a gap between the two parts of the upper paper stop, the stack of papers are also less likely to curl when abutting the upper paper stop 26, since no air cushion is formed between the paper and the upper paper stop 26.

In FIG. 1 an upper position for the upper paper stops 26 is shown in dashed lines. It is shown how the pivotable arms 26*a* have moved from the vertical positions shown in solid lines to essentially horizontal positions, bringing the upper paper stops 26 to a higher position. In this higher position, the upper paper stops 26 keep clear of the side blower units 18 when the paper tray is moved sideways to enable refilling thereof.

Preferred embodiments of a paper feeding device have been described. It will be appreciated that these can be modified without departing from the inventive idea as defined by the appended claims.

REFERENCE NUMERALS

10 Paper feeding device
12 Stack of papers
13 Stopping plate
14 Storage surface
14*a* Leading edge of storage surface
14*b* Trailing edge of storage surface
14*c* First side edge of storage surface
14*d* Second side edge of storage surface
15*a* Side paper guides
15*b* End paper guide
16 Vacuum feeder
18 Side blower units
18*a* Nozzle
18*b, c* Air openings of nozzle
20 Front blower unit,
20*a* First portion of air openings
20*b* Second portion of air openings
20*a*' First air cone
20*b*' Second air cone
22 Sensor arrangement
22*a* Infrared reflective sensors
22*b* Auxiliary IR diodes
24*a* First distance meter
24*b* Second distance meter
26 Upper paper stop
26*a* Pivotable arms of upper paper stop

The invention claimed is:

1. A paper feeding device comprising:

an elevator comprising a storage surface for a stack of papers, the storage surface having a leading edge, a trailing edge, and a first and a second side edge and being adapted to be move vertically between a first, lower end position and a second, upper end position, a vacuum feeder for feeding papers from their position on the storage surface and imparting an uppermost sheet of paper a horizontal displacement, a blower arrangement adapted to provide a curtain of air separating the uppermost sheet of paper from the rest of the stack of papers, characterized by a sensor arrangement arranged to determine where the upper paper sheets in the stack of papers provided on the elevator start to separate from the rest of the paper sheets, the sensor arrangement comprising a plurality of infrared reflective sensors arranged in at least one vertical row, wherein the infrared sensors are arranged in two parallel rows, and where in the two rows are vertically displaced relative to one another.

2. The paper feeding device according to claim 1, where in the two rows are vertically displaced by half the mutual distance between two sensors in a row.

3. The paper feeding device according to claim 1, wherein the sensors in a row have a mutual distance of 2 mm.

4. The paper feeding device according to claim 1, wherein the sensor arrangement also comprises auxiliary IR diodes.

5. The paper feeding device according to claim 1, wherein position of the stack of papers is determined by the vertical position of an uppermost sensor detecting reflection above a threshold value.

6. The paper feeding device according to claim 1, wherein the sensor arrangement is adapted to perform measurements at regular intervals.

7. A paper processing machine comprising a paper feeding device-according to claim 1.

* * * * *